US005967727A

United States Patent [19]

Ritsch et al.

[11] Patent Number: 5,967,727

[45] Date of Patent: Oct. 19, 1999

[54] TRANSPORT DEVICE FOR CONVEYING MOTOR VEHICLES IN BUILDINGS

[75] Inventors: Ingomar Ritsch, Breitenbach; Leo Schlager, Kufstein, both of Austria

[73] Assignee: Ingomar Ritsch, Breitenbach, Austria; by said Leo Schlager

[21] Appl. No.: 09/000,421

[22] PCT Filed: Nov. 13, 1996

[86] PCT No.: PCT/AT96/00219

§ 371 Date: Feb. 3, 1998

§ 102(e) Date: Feb. 3, 1998

[87] PCT Pub. No.: WO97/18368

PCT Pub. Date: May 22, 1997

[30] Foreign Application Priority Data

Nov. 15, 1995 [EP] European Pat. Off. ..... 95117978

[51] Int. Cl.[6] ..... E04H 6/00

[52] U.S. Cl. ..... 414/239; 414/495; 414/498; 414/458; 414/800

[58] Field of Search ..... 414/234, 253, 414/255, 240, 239, 495, 498, 458, 800

[56] References Cited

U.S. PATENT DOCUMENTS

| | | | |
|---|---|---|---|
| 3,348,710 | 10/1967 | James | 414/234 |
| 4,919,582 | 4/1990 | Bates et al. | 414/253 |
| 4,971,506 | 11/1990 | Givati | 414/253 |
| 5,013,203 | 5/1991 | Wakabayashi | 414/234 |
| 5,286,156 | 2/1994 | Ikenouchi et al. | 414/253 |
| 5,331,781 | 7/1994 | Gilbert | 414/253 |

FOREIGN PATENT DOCUMENTS

| | | |
|---|---|---|
| 0 414 626 A1 | 2/1991 | European Pat. Off. . |
| 0 563 664 A1 | 3/1993 | European Pat. Off. . |
| 1 263 271 | 3/1968 | Germany . |
| 38 20 891 C2 | 6/1992 | Germany . |
| 39 09 702 C2 | 4/1993 | Germany . |
| WO 87/02405 | 4/1987 | WIPO . |
| WO 92/03629 | 3/1992 | WIPO . |
| WO 92/10628 | 6/1992 | WIPO . |

*Primary Examiner*—Christopher P. Ellis
*Assistant Examiner*—Isobel Parker
*Attorney, Agent, or Firm*—Hale and Dorr LLP

[57] ABSTRACT

Driverless motor vehicles are conveyed to unoccupied parking spaces in a building by a transport system comprising at least two trackless transport elements and, for each motor vehicle, four detachable wheel support elements on the parking space and the two transport elements, on which wheel support elements the vehicle remains during parking in the parking space.

25 Claims, 3 Drawing Sheets

2/3

26
19
24
20
22
23
31
32
22
25
24
9
29
7
26
28
27
30
39
29
18
18
8
36
37
21
27
7
28
28
26
29
33
34
35
32
31
44
38
35
33
34
29
26

18
11
17
21
VIII
VIII
10
15
13
9
7

TRANSPORT DEVICE FOR CONVEYING MOTOR VEHICLES IN BUILDINGS

BACKGROUND OF THE INVENTION

The invention relates to a transport device for conveying automotive vehicles in a building, as well as to a method for garaging automotive vehicles.

In principal, different garaging systems for driverless vehicles can be differentiated, namely, those wherein the vehicles are transported on pallets by the transport means and are parked with the pallets and those wherein the vehicles are unloaded from the transport means and are put down without a base onto the parking places.

Both systems are subject to spatial limitations: If the vehicles remain on the pallets, each pallet must be configured for the largest vehicle to be garaged, so that with the large number of smaller vehicles, parking space is wasted. In addition, a pallet is required for each parking place, so that the expenditure in terms of equipment for such a garage is very high (for example, WO-A 87/0240).

If the vehicle is parked without pallets (for example according to EP-A 563 664), it becomes necessary to remove it from the transport means at the parking place, and respectively, when the vehicle is collected to re-load it onto the transport means. In addition, the transport means must be low enough to be removable from beneath the vehicle lowered onto the floor of the parking space, and, when tire damage occurs, can be inserted at the time of collection under a car which has sunk down even lower. The vehicles must be raised, wherein, as no lifting means is available at the parking places, such a means must be provided on the transport means.

The problems outlined are reduced when the parking level of the vehicle is above the floor of the garage, on which the transport means are moving. Nevertheless, additional means are necessary in the building for producing the parking level (for example, according to WO-A 92/03629 or WO-A 92/10628) and the height is increased considerably.

For pallet-free transport of the automotive vehicle, the transport means are provided with horizontally pivotable arms which grasp and lift up each wheel of the vehicle. The transport means must suit the different wheelbases of different vehicles. With respect to this, it has already been proposed in DE-C 38 20 891 or DE-C 39 09 702 to divide the transport means into two independent units. The transport means are track bound and can therefore go under the vehicle in only one direction, whereupon in the correct position the arms are pivoted out.

SUMMARY OF THE INVENTION

The object of the invention is to provide an improved garaging system in which both the constructional expenditure with respect to the building and the expenditure on equipment are kept as low as possible.

This is achieved in that the transport device is provided with at least one, in particular trackless, transport element, and for each automotive vehicle at least two supporting elements separable from the transport element at the parking place. A transport device is consequently composed of several parts, of which the supporting elements always remain with the automotive vehicle, while the substantially lesser number of transport elements are used only during transport to and from the parking place. After parking the vehicle together with its supporting elements, the transport elements are free again and can be used for the transportation of other vehicles. Hereinafter, the term transport means will be used for any conveying means required for an automotive vehicle, which is composed of one of two transport elements and two or four supporting elements, wherein, however, although the transport means is provided with supporting elements adjustable for any vehicle, it has substantially fewer transport elements in total. The space requirement on the parking area is derived from the size, in particular the length, of the automotive vehicle. The parking place has no pre-determined limit, but instead the spacings are pre-determined regardless of the size of the automotive vehicles. Each automotive vehicle always follows the one standing in front of it or adjacent to it, preferably with a maximum spacing of 10 cm. By virtue of the division of the supporting elements, the dimensions of the transport elements are reduced such that they can move underneath the parked vehicles. In this way the occupation density of the parking area can be increased significantly.

In a preferred embodiment, it is provided that the supporting element is provided with at least one pendent segment which can engage under the rising transport element. In this way, a minimum height of the transport means can be achieved, as lifting of the vehicle wheels by, for example, 1 or 2 cm is sufficient for transportation and the pendent segment is higher than the wheel supporting surface on the supporting elements. The pendent segment can, for example, form a bridge between the wheel supporting elements provided with the wheel supporting surfaces, wherein the transport element can go under the bridge piece after parking of the automotive vehicle on the supporting elements. On each supporting element a front, rear or side pair of automotive vehicle wheels is set down. The mobility of the transport means can be further increased in a preferred embodiment when in each case two wheel supporting elements, in particular the two wheel supporting elements of each vehicle axle, can be connected to a separate transport element. Consequently, the transport means for a vehicle is composed of two transport elements independent of one another, each of which is provided with two removable wheel supporting elements. In this embodiment, a pendent segment is provided on each wheel supporting element. The length and width of this transport element are also preferably selected such that it can also move between two transport elements transporting an automotive vehicle, the distance apart of which is independent of the wheelbase of the vehicle to be transported.

When a separate wheel supporting element is provided for each wheel, a store of wheel supporting elements corresponding to the maximum occupation of the parking area can be kept stacked in a space-saving manner.

Transport elements are even smaller when they are each connected to only one wheel supporting element, so that the automotive vehicle is conveyed by four transport elements independent of one another, however the use of one or two transport elements per two axle automotive vehicle should be provided from the point of view of expenditure on technology.

The necessary retention of the wheel in the wheel supporting element is preferably obtained in that it is provided with a supporting trough. In order to facilitate entering and exiting, a height adjustable central area is preferably provided on the supporting trough, so that the trough can be filled up at least when exiting. This can take place, for example, in that the wheel supporting elements in the exit area, and respectively in the entrance area, can be lowered onto blocks projecting from the floor which raise the central area of the trough.

The transport element according to the invention is preferably provided with a frame which can be connected to at least one wheel supporting element, and is arranged on a chassis moveable in at least two directions. By combining the two directions, any desired movement of the transport element and of the transport means can be put together. In a further embodiment it is provided that the chassis is also moveable in at least one arc of a circle, so that the transport means can be rotated, for example, by 90°. Further, it is advantageous when the chassis is provided with at least two wheels which can each be turned by at least 90°. Preferably, the chassis is composed of at least four wheels which can be turned by at least 90°. The chassis is in particular electrically driven, and can be fitted with preferably replaceable accumulators for this purpose. Preferably at least two turning wheels are driven, wherein single motors or a common drive motor can be provided for the driving. In a further embodiment, the turning wheels can also be provided with a common rotary drive.

For connection to the supporting, and respectively, to the wheel supporting elements, the transport elements are provided with connecting elements which are height-adjustable relative to the wheels. The lifting drive provided for this in the transport element is preferably provided with a hydraulic unit acting horizontally in the transport element, and a traction mechanism converting the horizontal movement into a vertical movement, which is guided by means of at least one guide roller and is connected to the connecting element. In addition, preferably, the frame of the transport element is then also raised, from which the connecting elements project outwards. A chain, a cable or the like can be used as a traction mechanism. Naturally, instead of the hydraulic lifting drive, another lifting drive is possible, for example an electric spindle drive and so forth. In order to be able to make the transport elements as small as possible, it is further preferably provided that the height-adjustable connecting elements can be pushed horizontally out of the transport element.

Hereinafter, the invention will be described in more detail with reference to the attached drawings, without being limited thereto:

BRIEF DESCRIPTION OF DRAWINGS

There is shown, in

DESCRIPTION OF PREFERRED EMBODIMENTS

Figure 1:
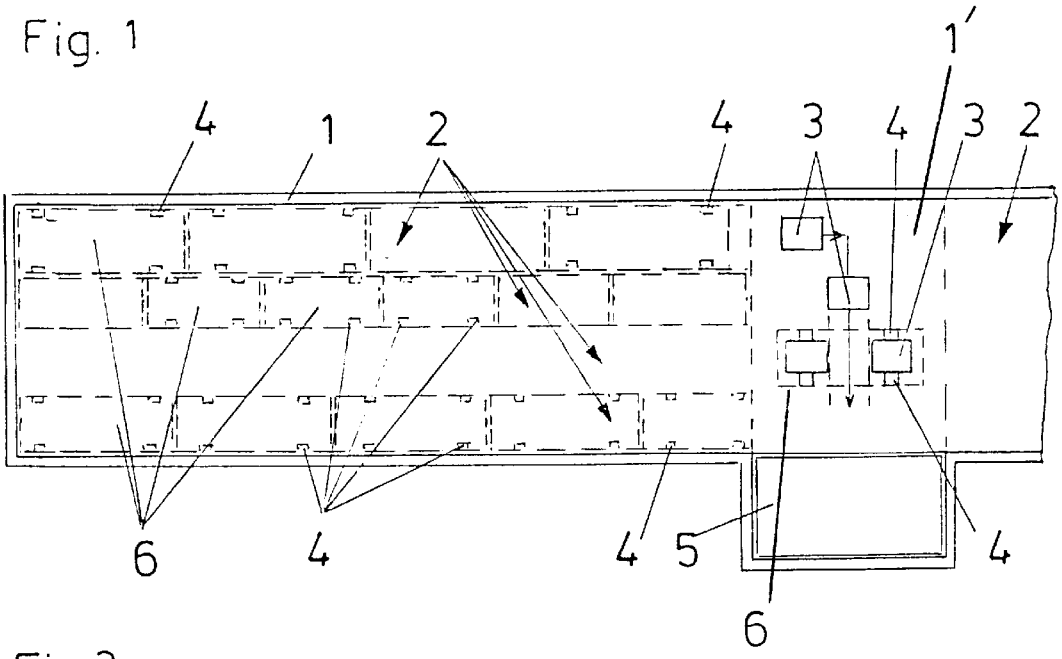
FIG. 1 a parking level or a garage with important parts of the transport device, FIG. 2 a view of a transport means in the receiving or parking position, FIG. 3 a schematic vertical section through the transport means, wherein the right-hand half shows the transporting position, FIG. 4 a view of the transport means in the unloading position, FIG. 5 a horizontal section through a transport element, FIG. 6 a plan view of a steerable wheel of the chassis, FIG. 7 a side view of a steerable wheel, and FIG. 8 a section according to line VIII—VIII of FIG. 6.

A building 1 for accommodating automotive vehicles, in particular a garage or a store, is provided with at least one parking level. Within each floor level there are neither pillars nor separating walls, so that the size of each parking place 2 is always matched to the automotive vehicle parked there. As shown, parking lines of different widths are produced when vehicles of different widths are parked, and the number of parking places along the length of the parking area is also variable. The length and width of the parking area are selected such that as variable as possible a division is possible without large wastage of space. The parking area shown in FIG. 1 has, for example, a length of 22.5 m, and a width of 8 m. The automotive vehicles 6 are parked quite closely to one another, regardless of their size, wherein in particular a safety gap of a maximum 10 cm is maintained longitudinally. A hand-over or collection station, or in the preferred case of a building with several levels, a lift, is labelled 5. In order to obtain as rapid access as possible to each parked automotive vehicle 6 when there is the dense arrangement of the automotive vehicles 6 shown, or in order to also be able to transport a newly arrived automotive vehicle 6 to a parking place 2 not directly accessible, the transport device must be provided with transport means, the transport elements of which can also move in all directions possible underneath the parked automotive vehicles 6, and are capable of loading and unloading the automotive vehicle 6 at the respective parking place.

For this purpose, a transport means is composed of at least one transport element 3, and at least two supporting elements for the wheels of the automotive vehicle 6, separable from the transport element 3. Preferably one transport element 3 and two separable wheel supporting elements 4 are provided per vehicle axle, that is to say each normal passenger vehicle 6 is transported by two individual independent transport elements 3, on which four individual wheel supporting elements 4 are provided, on which the vehicle parked in the parking place 2 remains. The empty transport elements 3 are therefore short and narrow enough to move underneath the parked vehicles 6 and can also cross a transport means transporting a vehicle 6, as is shown in FIG. 1. The transport elements 3 are in particular trackless in order to be able to move at right-angles within the parking area, and can be remotely controlled or autonomously moved, wherein appropriate sensors recognise obstacles and control the transport elements. However, the mobility of the transport elements 3 is only slightly less when they are track bound, as in this case also, right-angled as well as longitudinal movements of the transport elements 3 released from the wheel supporting elements 4 are possible, when corresponding guides are configured in the floor.

Figure 2:
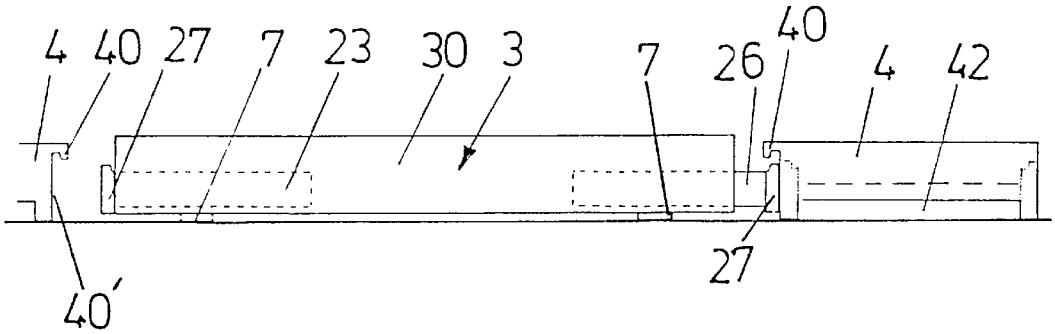
Figure 3:
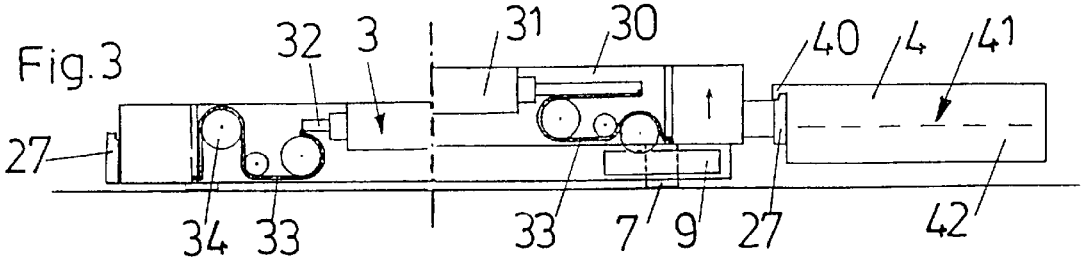

There is a store of wheel supporting elements 4 in a hand-over station 1', wherein a vehicle 6 arriving drives onto four of these wheel supporting elements. For definitive positioning, the wheel supporting elements are provided with supporting troughs 41 which are formed by a height adjustable base plate 42. Each two wheel supporting elements 4 are received by one transport element 3, as shown in FIGS. 2 and 3. The transport elements are smaller in width than the smallest wheelbase of any vehicle which can be parked in the building, and are provided with laterally moveable strip-shaped connecting elements 27. Each transport element 3 comprises a chassis 8 and a frame 30 arranged in a height adjustable manner on the chassis 8, on which frame drive rods 26 and hydraulic pushing out elements 28. 29 for the connecting elements 27 are mounted.

Figure 4:
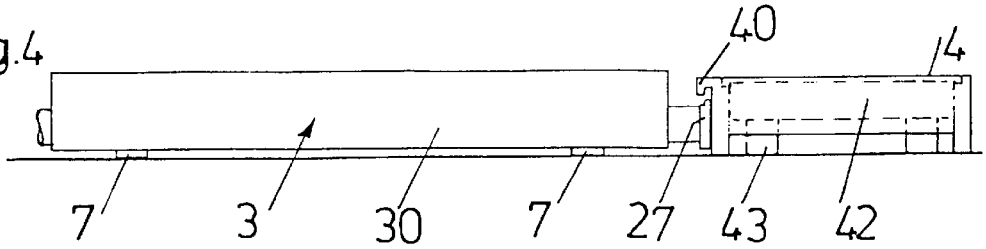
Figure 5:
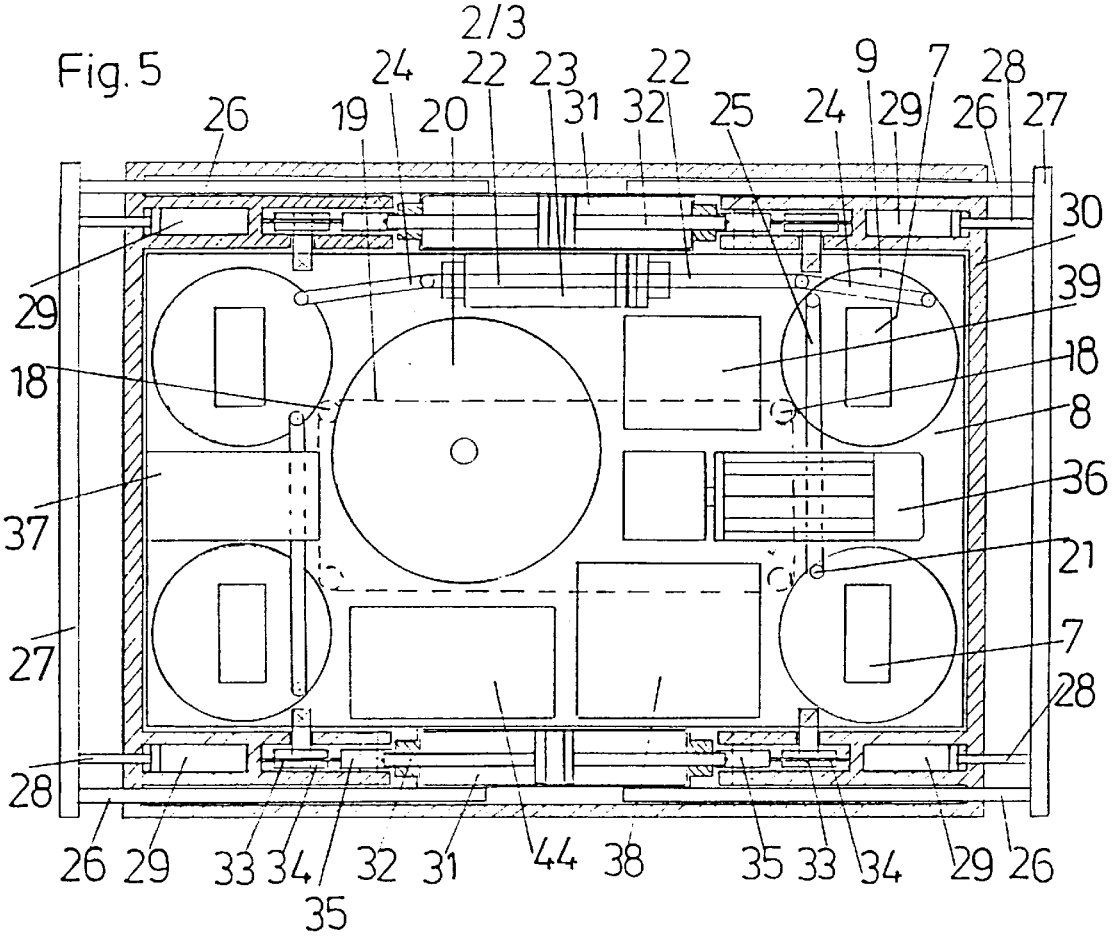
Figure 6:
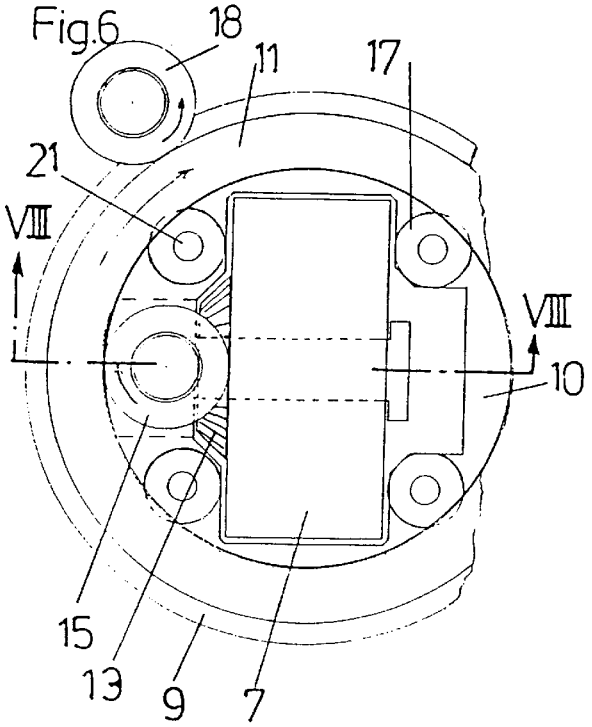
Figure 7:
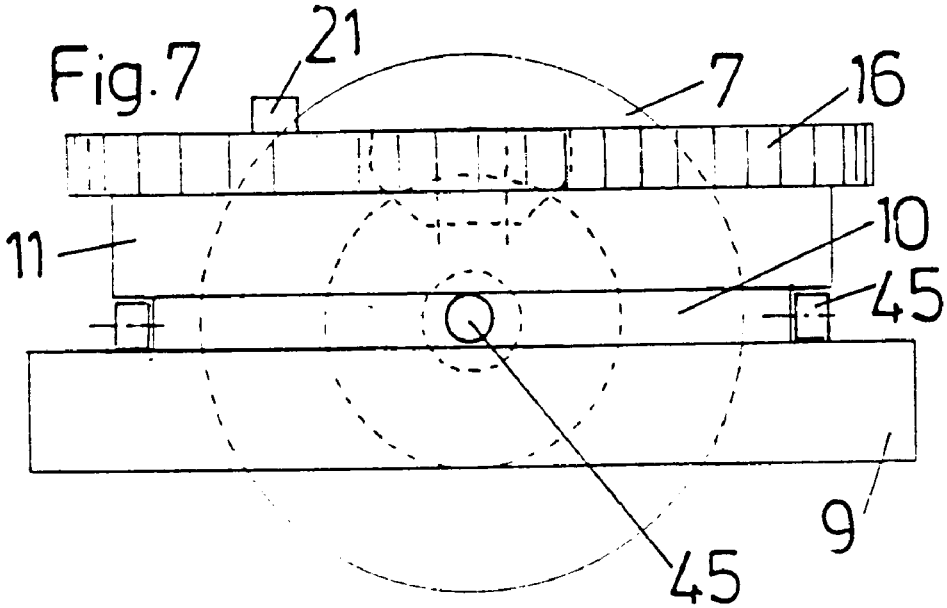
Figure 8:
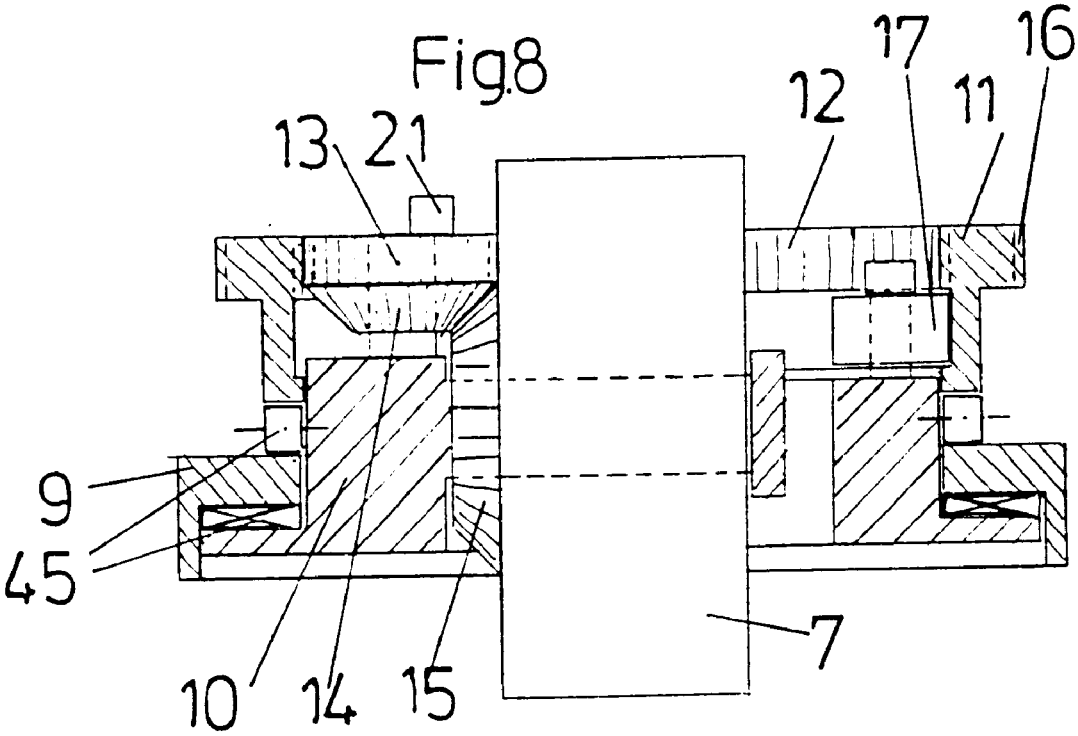

After the connecting elements 27 are pushed out as far as the stop 40' on the wheel supporting elements 4 weighed down by the vehicle 6, the lifting device 31, 32, which is also hydraulic, is actuated, by means of which the frame 30 is lifted, wherein the connecting elements 27 engage over pendent segments 40 of the wheel supporting elements 4, and consequently raise the automotive vehicle 6 (FIG. 3, right-hand side). At the parking place 2 the frame 30 and the connecting elements 27 are lowered again, wherein the connecting elements 27 are released from the pendent segments 40, and after withdrawal of the connecting elements 27, the transport elements 3 move away, so that they can be used for the next transport means. If a vehicle is brought to the hand-over station, the wheel supporting elements 4 are lowered onto blocks 43 projecting from the floor, so that the base plate 42 is lifted and the supporting trough 41 of each wheel supporting element 4 is levelled (FIG. 4).

A preferred embodiment of a transport element 3 is shown in detail in FIGS. 5 to 8. It comprises a chassis 8 in which four wheels 7 are provided. Each wheel 7 is rotatably mounted on a bearing block 10, which is arranged rotatably about a vertical axis by means of bearings 45, in a wheel housing 9, which is fixed to the chassis 8. The bearing block 10 carries, on its top side, rollers 17 which bear a ring 11 in a rotatable manner, which is provided with internal teeth 12 and external teeth 16. An intermediate gear 13 which is connected to a conical gear 14 engages with the internal teeth 12. This meshes with a conical gear 15 which is fixed onto the wheel, that is to say the moving roller 7. A driving gear 18 of the travelling mechanism engages with the external teeth of the ring 11, which mechanism, for example, comprises a common drive motor 20 and a flexible drive 19 connected to all the driving gears 18. The wheels 7 can be turned by means of a rotary drive, which is provided with a dual-action hydraulic cylinder 23 with piston rods on both sides 22, as well as guide rods 24 and coupling rods 25. The guide rods 24 and the connecting rods 25 are connected to steering pivots 21 projecting above the ring 17, which are arranged on the rotatably mounted bearing block 10 of the wheel 7, and preferably form axles of the rollers 17.

The chassis 8 further comprises a hydraulic pump 36, a pressure tank 37 and control valves 39, by means of which the two hydraulic lifting devices 31, 32 and the four hydraulic pushing out devices 28, 29 are also served. Traction mechanisms 33 are attached to the piston rods 32 of the lifting device protruding out of the pressure cylinders 31, each of which is guided by means of at least one roller 35 mounted in the liftable frame 30 and a roller 34 mounted in the chassis 8, and attached to the frame 30. The pushing out of the piston rods 32 therefore reduces the belt loop lengths of the rollers 34, so that the frame rises relative to the chassis 8 (FIG. 3, right-hand side).

A control means 38 as well as a replaceable accumulator 44, is further arranged in each chassis. Instead of the hydraulic drive described for the pushing out of the connecting elements 27, electric drives can also be provided for lifting the frame 30 and turning the wheels 7.

When the transport means is provided with only one transport element 3 and two supporting elements, in each case for one pair of wheels, when the frame 30 is raised the pushed-out connecting elements 27 each engage from below with a pendent segment formed by a bridge piece which connects the two wheel supporting elements 4 of each pair of wheels. The connecting elements 27 are additionally provided with lateral, in particular hydraulically extending, spacers, which are braced against the wheel supporting elements 4 in order to prevent deformation of the bridge piece.

We claim:

1. Transport device for parking automotive vehicles on a flat parking area of a building, said transport device comprising:

at least one trackless transport element, and, for each automotive vehicle, at least two supporting means separable from the transport element at a parking place and engageable by said trackless transport element, whereby when said transport elements engage said supporting elements said automotive vehicles can be moved.

2. Transport device according to claim 1, wherein said transport element is provided with height-adjustable connecting elements, and wherein each of said supporting means comprises at least one upper segment engaged from below by one of said connecting elements, said supporting means being separable from the transport element by lowering said connecting elements.

3. Transport device according to claim 1, wherein each of said supporting means comprises two wheel supporting elements.

4. Transport device according to claim 3, wherein each of said wheel supporting elements comprises a supporting trough.

5. Transport device according to claim 4, wherein said supporting trough is provided with a height-adjustable central area.

6. Transport device according to claim 1, wherein said transport element comprises a chassis movable in at least two directions.

7. Transport device according to claim 6, wherein said chassis is movable in an arc of a circle.

8. Transport device according to claim 6, wherein said chassis comprises wheels, at least two wheels being turnable by at least 90°.

9. Transport device according to claim 8, wherein said wheels are provided with a common drive.

10. Transport device according to claim 9, wherein said common drive comprises a hydraulic drive and coupling rods between said wheels.

11. Transport device according to claim 2, wherein each of said connecting elements is provided with a hydraulic lifting drive.

12. Transport device for parking automotive vehicles on a flat parking area of a building, said transport device comprising:

at least one trackless transport element, and, for each automotive vehicle, at least two supporting means separable from the transport element at a parking place and engageable by said trackless transport element, said transport element being provided with height-adjustable connecting elements controlled by a hydraulic lifting drive, and wherein each of said supporting means comprises at least one upper segment engaged from below by one of said connecting elements, said supporting means being separable from the transport element by lowering said connecting elements, said lifting drive including a hydraulic unit acting horizontally in the transport element and a traction mechanism converting the horizontal action of the hydraulic unit into a vertical movement of the connecting element, said traction mechanism being guided over at least one guide roller, whereby when said transport elements engage said supporting elements, said automotive vehicles can be moved.

13. Transport device for parking automotive vehicles on a flat parking area of a building, said transport device comprising:

at least two movable transport elements, and, for each automotive vehicle, wheel supporting elements, two of said wheel supporting elements being separable from each of said transport elements at a parking place and engageable by each of said transport elements, whereby when said transport elements engage said supporting elements, said automotive vehicles can be moved.

14. Transport device according to claim 13, wherein each of said transport elements is provided with two height-adjustable connecting elements, and wherein each of said wheel supporting elements comprises an upper segment engaged with from below by one of said connecting elements, said wheel supporting elements being separable by lowering said connecting elements.

15. Transport device according to claim 13, wherein each of said wheel supporting elements comprises a supporting trough.

16. Transport device according to claim 15, wherein said supporting trough is provided with a height-adjustable central area.

17. Transport device according to claim 13, wherein said transport element comprises a chassis movable in at least two directions.

18. Transport device according to claim 17, wherein said chassis is movable in an arc of a circle.

19. Transport device according to claim 17, wherein said chassis comprises wheels, at least two wheels being turnable by at least 90°.

20. Transport device according to claim 19, wherein said wheels are provided with a common drive.

21. Transport device according to claim 20, wherein said common drive comprises a hydraulic drive and coupling rods between said wheels.

22. Transport device according to claim 14, wherein each of said connecting elements is provided with a hydraulic lifting drive.

23. Transport device according to claim 22, wherein said lifting drive comprises a hydraulic unit acting horizontally in the transport element and a traction mechanism for converting the horizontal action of the hydraulic unit into a vertical movement of the connecting element, said traction mechanism being guided over at least one guide roller.

24. Method for parking automotive vehicles on a flat parking area of a building comprising the steps of:

loading an automotive vehicle onto a transport device which includes a trackless transport element and two supporting means separable from the transport element at a parking place, conveying the automotive vehicle to the parking place, and parking the automotive vehicle in a parking space without predetermined boundaries at a predetermined distance apart from other parked vehicles independent of the size of the vehicles.

25. Method for parking automotive vehicles on a flat parking area of a building comprising the steps of:

loading each automotive vehicle onto a transport device which includes two transport elements and four wheel supporting elements separable from the two transport elements at a parking place, conveying the automative vehicle to the parking place, and parking the automotive vehicle on the separated wheel supporting elements at a predetermined distance apart from another parked vehicle.

* * * * *